US006329903B1

(12) United States Patent
Yamamori

(10) Patent No.: US 6,329,903 B1
(45) Date of Patent: Dec. 11, 2001

(54) WRIST WATCH-STYLE PAGER

(75) Inventor: Takeshi Yamamori, Sendai (JP)

(73) Assignee: OI Denki Co., Ltd., Yokohama (JP)

( * ) Notice: Subject to any disclaimer, the term of this patent is extended or adjusted under 35 U.S.C. 154(b) by 0 days.

(21) Appl. No.: 08/439,523

(22) Filed: May 12, 1995

Related U.S. Application Data

(62) Division of application No. 08/292,418, filed on Aug. 18, 1994, now Pat. No. 5,986,566.

(51) Int. Cl.[7] ..... H01Q 1/12
(52) U.S. Cl. ..... 340/7.63; 368/10; 343/718
(58) Field of Search ..... 340/825.44; 343/718, 343/741; 455/351; 368/10

(56) References Cited

U.S. PATENT DOCUMENTS

| | | | | |
|---|---|---|---|---|
| 4,754,285 | | 6/1988 | Robitaille | 343/718 |
| 4,786,902 | * | 11/1988 | Davis et al. | 340/825.44 |
| 4,845,485 | * | 7/1989 | Pace | 340/825.44 |
| 4,922,260 | | 5/1990 | Gaskill et al. | 343/718 |
| 5,007,105 | * | 4/1991 | Kudoh et al. | 343/718 X |
| 5,134,724 | | 6/1992 | Gehring et al. | 455/274 |
| 5,144,325 | | 9/1992 | Kurcbart | 343/718 |
| 5,159,713 | * | 10/1992 | Gaskill et al. | 340/825.44 X |
| 5,179,733 | * | 1/1993 | Matsui | 455/351 X |
| 5,280,296 | * | 1/1994 | Tan et al. | 343/718 |
| 5,280,645 | | 1/1994 | Nguyen et al. | 455/274 |
| 5,450,091 | * | 9/1995 | Hama | 343/718 |
| 5,465,098 | | 11/1995 | Fujisawa et al. | 343/718 |
| 5,532,705 | * | 7/1996 | Hama | 343/718 |

FOREIGN PATENT DOCUMENTS

| | | | | |
|---|---|---|---|---|
| 100-639-A | * | 2/1984 | (EP) | 343/718 |
| 348636A | | 3/1990 | (EP) . | |
| 61-181203 | * | 8/1986 | (JP) | 343/718 |
| 237805 | | 2/1990 | (JP) . | |
| 419038 | | 2/1992 | (JP) . | |
| 2-140002 | | 5/1992 | (JP) . | |
| 5-276056 | | 10/1992 | (JP) . | |
| 5-3446A | | 1/1993 | (JP) . | |

* cited by examiner

*Primary Examiner*—Michael Horabik
(74) *Attorney, Agent, or Firm*—Hogan & Hartson, L.L.P.

(57) ABSTRACT

A wrist watch-style pager prevents connection failure and/or breakdown due to attachment/detachment of a loop antenna and has a receivable frequency band which is not affected by the thickness of the wearer's arm. A U-shaped antenna structure is mounted inside a wrist band part which is part of the wrist band divided at the center fastening structure. The U-shaped structure functions as an independent antenna on at least one part of the wrist band. The antenna is buried in the wrist band part so that the two ends of its U-shaped structure face toward a page mainbody. When each of two contact pins on the ends of the U-shaped structure connect the wrist band with the pager mainbody, a terminal spring on a reception circuit substrate of the pager mainbody is pressed. This causes the receiving signal from the antenna to be conveyed to the page mainbody.

14 Claims, 3 Drawing Sheets

WRIST WATCH-STYLE PAGER

This is a division of application Ser. No. 08/292,418 filed Aug. 18, 1994 now U.S. Pat. No. 5,986,566.

BACKGROUND OF THE INVENTION

1. Field of the Invention

This invention relates to a wrist watch-style pager, and more particularly to a wrist watch-style pager having an antenna mounted inside a band of the pager.

2. History of the Prior Art

Pagers which radio transmit telephone calls and/or messages to a wearer when the wearer is out, are widely used. Due to the fact that such pagers are carried on the wearer constantly, miniaturization of the pagers is desirable. On the other hand, conventional pagers generally are convenient for carrying, due to clip holders that allow the wearer to clip the pager on waist belts or pockets. However, reading the display of a message received while the pager is clipped on can be difficult.

As a result, in recent years wrist watch-style pagers that are easy to carry and that allow easy reading of the display with the pager still worn when paged have become common. Movever, it has been extremely difficult to mount an antenna on the pager mainbody in such wrist watch-style pagers, due to certain restrictions. For example, the pager's mainbody case cannot be metal, and the pager mainbody must be miniaturized and light in weight.

For this reason, it has been proposed to mount the antenna inside the wrist band of wrist watch-style pagers 10 as shown in FIG. 3. By doing this, the antenna can be made long enough to receive frequency signals beyond the VHF band (30–300 MHz). Furthermore, although ferrite antennas are preferable over loop antennas, in terms of the antenna's receiving capability, loop antennas are ideal for mounting inside the wrist band because the shape of such antennas can be changed. The loop antenna can be formed in unitary fashion inside the wrist band, which is connected to the mainbody of the pager to form a continuous loop via a center fastening structure of the wrist band when the band is fastened. However, in such arrangements the loop connection at the center fastening structure significantly influences reception. Consequently it is difficult to design a mechanism that provides favorable operation, as this part is prone to break down. In addition, the wrist band typically contains a wrist band adjusting structure at the center fastening structure to adjust the length of the wrist band to the thickness of the wearer's arm. This adjustment causes the antenna's loop length to vary from wearer to wearer, which causes variations in the receivable frequency band from one wearer to another.

Accordingly, it would be desirable to prevent connection failure and/or breakdown due to attachment/detachment of a loop antenna and to provide a wrist watch-style pager whose receivable frequency band is not affected by the thickness of the wearer's arm.

BRIEF DESCRIPTION OF THE INVENTION

To solve the problems of the prior art, pagers according to the invention comprise a pager mainbody, a center fastening-type wrist band fixed to the opposite ends of the pager mainbody and an antenna mounted inside the wrist band to receive call signals. The antenna has a U-shaped structure and is mounted inside at least one part of the wrist band, and the opposite ends of the U-shaped structure of the antenna connect with the pager mainbody.

In the wrist watch-style pagers according to the invention, there are extremely few instances of antenna failure due to attachment/detachment. The receivable frequency band is not affected by the thickness of the wearer's arm, since the antenna is mounted inside of at least one part of the wrist band. Further, the antenna does not go through the center fastening structure, so that it functions as an independent antenna in at least one part of the wrist band.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 3:
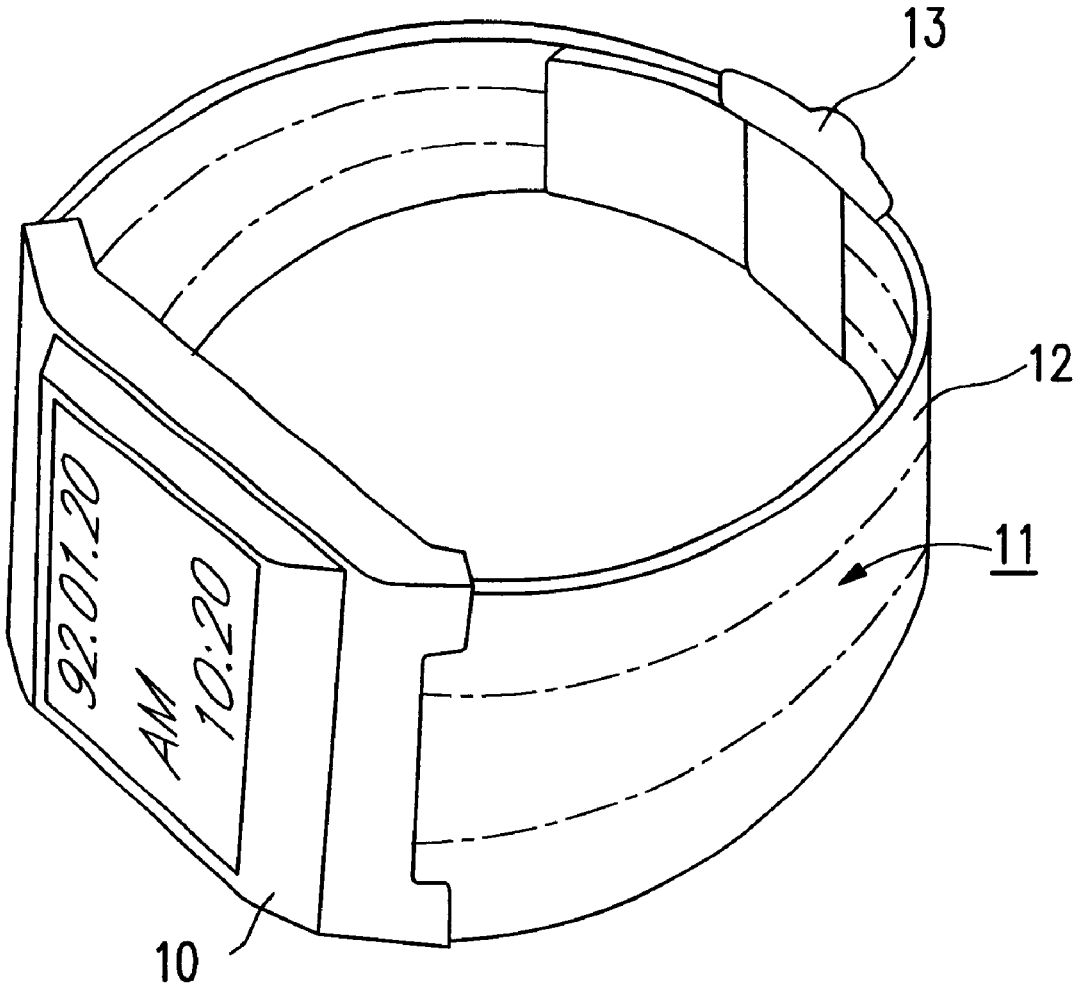
FIG. 3 PRIOR ART
FIG. 3 is a perspective view of a prior art wrist watch-style pager.

Referring first to FIG. 3, such figure shows a conventional technique for of mounting an antenna inside a wrist band. A loop antenna 11 is formed, in unitary fashion, inside a wrist band 12. The wrist band 12 is connected to a pager mainbody 10 so as to form a continuous loop via a center fastening structure 13 of the wrist band 12 when the wrist band 12 is fastened.

In the conventional wrist watch-style pager of FIG. 3, the loop connection at the center fastening structure 13 significantly influences reception. Consequently, and as previously noted, it is difficult to design a mechanism that provides favorable operation, as this part is prone to breakdown. In addition, the wrist band 12 contains a wrist band adjusting structure at the center fastening structure 13 to adjust the length of the wrist band 12 to the thickness of the wearer's arm. This adjustment causes the antenna's loop length to vary from wearer to wearer, which causes variations in the receivable frequency band from one wearer to another.

Figure 1:
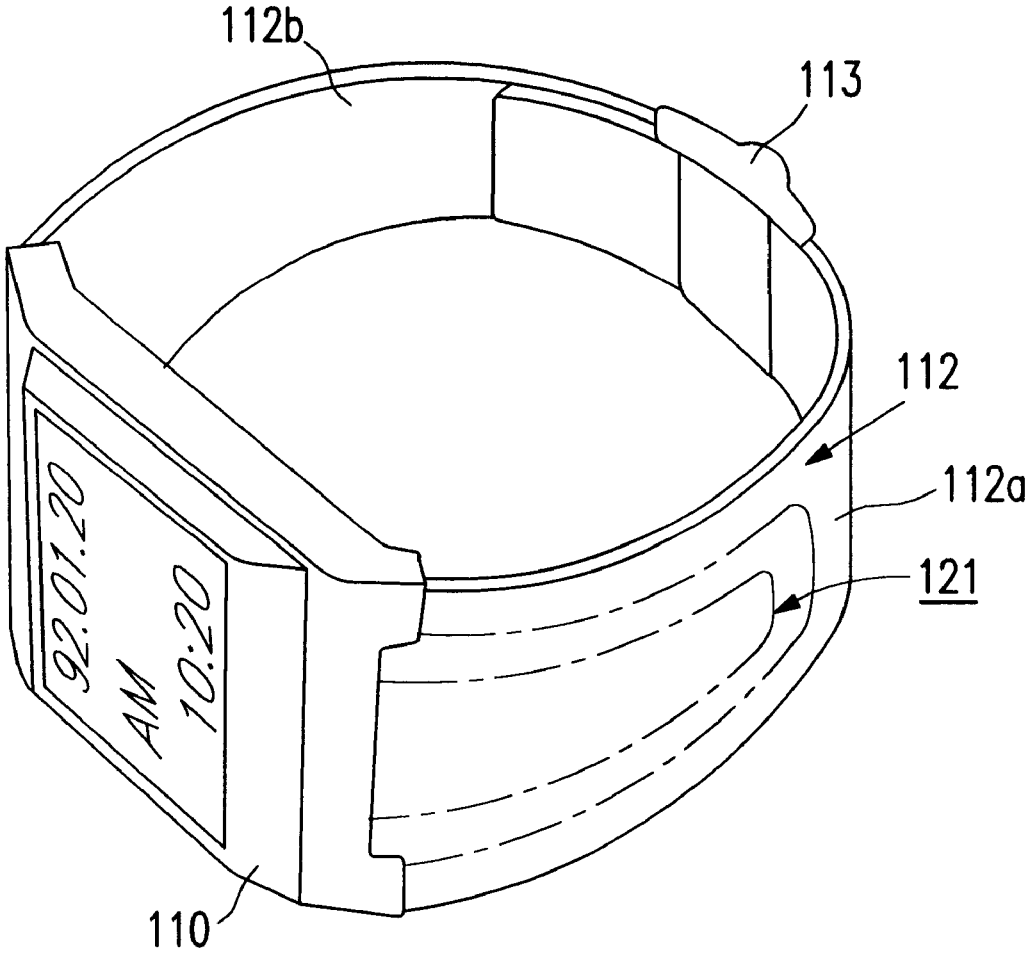
FIG. 1 is a perspective view of a wrist watch-style pager in accordance with the invention.

FIG. 1 shows an example of a wrist watch-style pager with a mounted antenna, according to the invention. The pager of FIG. 1 includes a pager mainbody 110 and a wrist band 112. The wrist band 112 has upper and lover surfaces and a fastening structure at its center and consists of a pair of wrist band parts, wrist. band 112*a* and wrist band 112*b*, each of which is attached to an end of the pager mainbody 110. A receiving antenna 121 is mounted inside the wrist band part 112*a*.

As FIG. 1 shows, the antenna 121 has a U-shaped structure and is mounted inside at least one part of the wrist band 112. The wrist band 112 is divided at a center fastening structure 113, so that it functions as an independent antenna in at least one part of the wrist band. This eliminates the need for mounting the antenna 121 throughout the wrist band 112 via the center fastening structure 113, which also eliminates the need to create a mechanism that would improve the connection between the antenna inside the center fastening structure 113. Moreover, reception would be possible without having the wrist band 112 form a loops as it does when worn.

As for the material of the antenna to be used in the example of FIG. 1, a natal with low resistance is preferable, particularly copper (Cu) plating.

Figure 2:
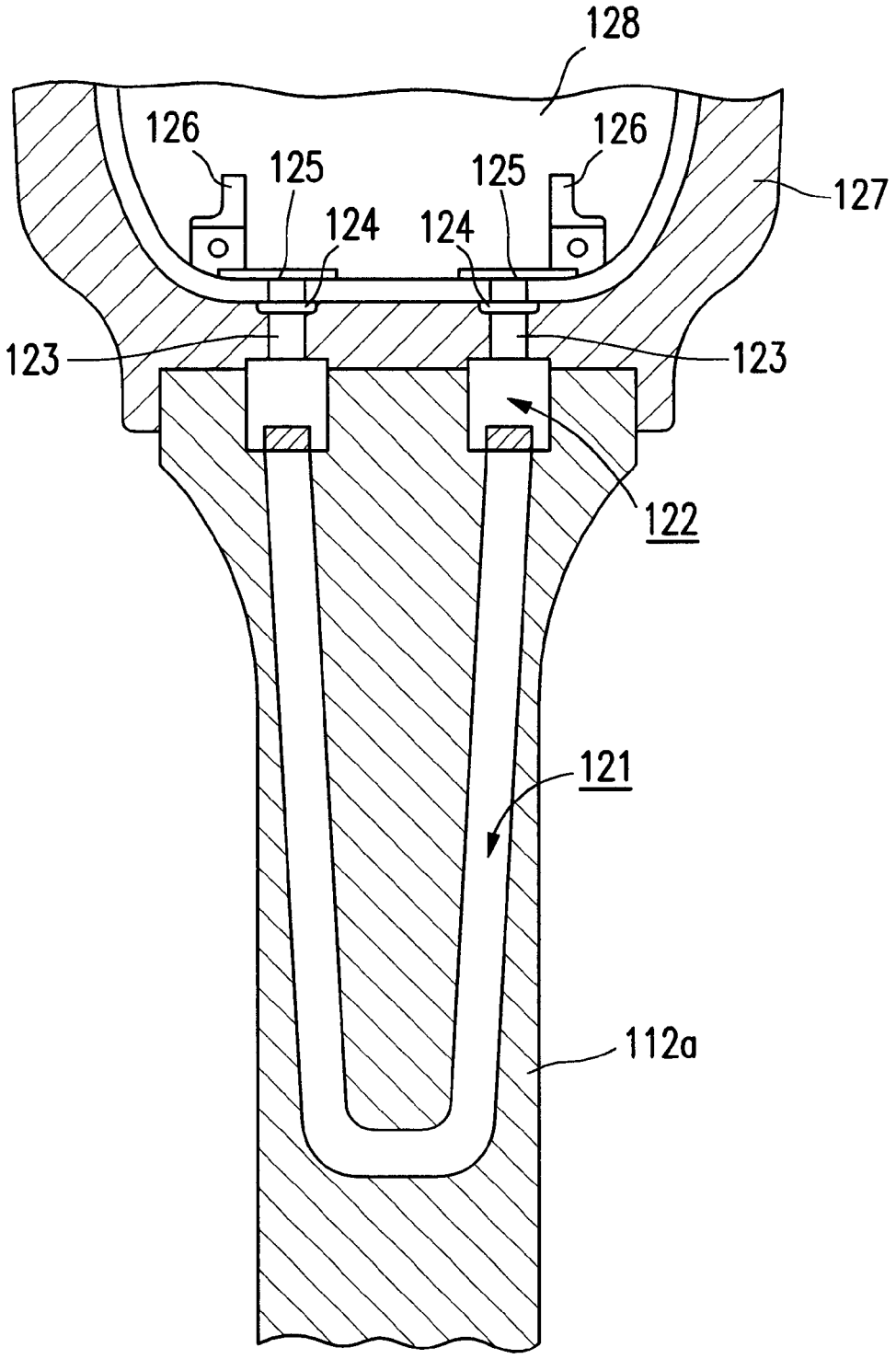
FIG. 2 is a sectional view of a portion of the wrist watch-style pager of FIG. 1.

The following is a detailed explanation of the mounting of the antenna and of the connection thereof with the pager mainbody 110, referring to FIG. 2. The antenna 121 is buried inside the wrist band 112, so that the two opposite ends of its U-shaped structure face the pager mainbody 110. In this example, the antenna 121 is buried inside the wrist band part 112*a,* which is the part that connects with the pager mainbody 110 through a rubber insert molding.

At each of the two opposite ends of the U-shaped structure, the antenna 121 is buried in the wrist band 112, and terminal 22 provides connection with the pager mainbody 110. At the tip of each terminal 122 is a contact pin 123, which is surrounded by an O-ring 124 somewhere along its length to prevent foreign matter from entering the pager mainbody 110 and for better sealing. Each of the terminals 122 is soldered at the ends of the antenna 121.

The pager mainbody 110 is entirely protected by a receiver case 127. On the front is a liquid crystal panel to display time, call message, and so forth, and on the back area is a known reception circuit substrate, a reception circuit, a battery, a speaker, and so forth. At each of the two locations on a reception circuit substrate 128, in the vicinity of its connection with the wrist band 112, is a circuit pattern 26 and beyond it a terminal spring 125, which is molded.

Consequently by connecting the wrist band 112 with the pager mainbody 110, both of the terminal springs 125 are pressed by both of the contact pins 123, which are protrusions on the terminal 122 located at the ends of the wrist band 112. This conveys receiving signals from the antenna 121 to the pager mainbody 110.

In certain cases, it is possible to secure the ends of the U-shaped antenna 121 buried in the wrist band 112 and a part of the reception circuit of the pager mainbody 110 by soldering the lead wires. Alternatively, it is also possible to have pins extend from the mainbody 110 and have spring contacts housed with the band.

Thus, as described above, wrist watch-style pagers in accordance with the invention have an antenna mounted inside at least one part of the wrist band. Consequently, there are extremely few instances of antenna failure due to attachment/detachment, and the receivable frequency band is not affected by the thickness of the wearer's arm. Furthermore, the antenna does not go through the center fastening structure, which allows the antenna to function as an independent antenna on at least one part of the wrist band.

What is claimed is:

1. A wrist watch-style pager comprising:

a receiver for receiving signals disposed within a main body having opposed ends;

an elongated bendable band having upper and lower surfaces and opposed ends, each end defining an opening at the same opposed end of the main body; and a loop antenna extending between the surfaces of the band to receive signals, wherein the antenna has a substantially U-shaped structure having two opposed ends located at the same end of the band, each end having an RF coupler extending through an opening and coupled to the receiver to communicate signals from the antenna to the receiver, and wherein the loop antenna extends the length of approximately less than one-half the length of the band.

2. The wrist watch-style pager of claim 1, wherein the couplers of the U-shaped antenna extend into the main body and engage the receiver.

3. The wrist watch-style pager of claim 2, wherein the couplers of the U-shaped antenna are soldered to the receiver.

4. The wrist watch-style pager of claim 1, further including at least two pins, wherein at least one pin is engaged with each RF coupler of the U-shaped antenna, and wherein the pins extend into the main body and engage the receiver to communicate signals from the antenna to the receiver.

5. The wrist watch-style pager of claim 1, wherein the couplers communicate signals to the receiver.

6. The wrist watch-style pager of claim 5, wherein at least one contact pin is mounted on each coupler, wherein the contact pins extend from the antenna terminal contacts into the main body, and wherein the contact pins are coupled to the receiver to communicate received signals from the antenna to the receiver.

7. The wrist watch-style pager according to claim 6, wherein each contact pin extends through at least one O-ring seal to a pair of terminal springs and wherein each contact pin is coupled to the receiver.

8. The wrist watch-style pager of claim 1, wherein the elongated band is comprised of separable parts, wherein one of the separable parts has the antenna mounted entirely therein, and further including a fastener linking the separable parts.

9. The wrist watch-style pager of claim 8, wherein the RF couplers of the U-shaped antenna extend into the main body and engage the receiver.

10. The wrist watch-style pager of claim 9, wherein the opposed ends of the U-shaped antenna are soldered to the receiver.

11. The wrist watch-style pager of claim 8, further comprising at least two pins, wherein at least one pin engages each of the opposed ends of the U-shaped antenna, and wherein the pins extend into the main body and engage the receiver to communicate signals from the antenna to the receiver.

12. The wrist watch-style pager of claim 8, further comprising two antenna terminal contacts, one contact located at each opposed end of the U-shaped antenna, and wherein the antenna terminal contact communicates signals to the receiver.

13. The wrist watch-style pager of claim 12, wherein at least one contact pin is mounted on each antenna terminal contact, and wherein the contact pins extend from the antenna terminal contacts into the main body and engage the receiver to communicate received signals from the antenna to the receiver.

14. The wrist watch-style pager according to claim 13, wherein each contact pin extends through at least one O-ring seal to a pair of terminal springs, and wherein the terminal springs engage the receiver.

* * * * *